US011739565B2

(12) United States Patent
Marsden

(10) Patent No.: US 11,739,565 B2
(45) Date of Patent: Aug. 29, 2023

(54) LATCH ASSEMBLY TO SECURE OPENING OF AN ENCLOSURE

(71) Applicant: Elbee Pty Ltd., Bondi Junction (AU)

(72) Inventor: Andrew Marsden, Hingham, MA (US)

(73) Assignee: Elbee Pty Ltd., Bondi Junction (AU)

( * ) Notice: Subject to any disclaimer, the term of this patent is extended or adjusted under 35 U.S.C. 154(b) by 9 days.

(21) Appl. No.: 17/031,795

(22) Filed: Sep. 24, 2020

(65) Prior Publication Data

US 2022/0090412 A1 Mar. 24, 2022

(51) Int. Cl.

| | |
|---|---|
| ***E05B 65/00*** | (2006.01) |
| ***E05C 1/10*** | (2006.01) |
| ***E05C 19/06*** | (2006.01) |
| ***E05C 19/10*** | (2006.01) |
| ***E05B 65/46*** | (2017.01) |

(52) U.S. Cl.

CPC ..... *E05B 65/0014* (2013.01); *E05B 65/46* (2013.01); *E05C 1/10* (2013.01); *E05C 19/06* (2013.01); *E05C 19/10* (2013.01)

(58) Field of Classification Search

CPC ..... E05B 65/0014; E05B 65/44; E05B 65/46; E05B 2015/0468; E05C 1/00; E05C 1/004; E05C 1/08; E05C 1/085; E05C 1/10; E05C 3/00; E05C 3/006; E05C 3/008; E05C 3/12; E05C 3/14; E05C 5/00; E05C 19/06; E05C 19/10; Y10T 292/0894; Y10T 292/0902; Y10T 292/0905; Y10T 292/0911; Y10T 292/0926; Y10T 292/0934; Y10T 292/0951; Y10T 292/0952; Y10T 292/0953; Y10T 292/0956; Y10T 292/0957; Y10T 292/0959; Y10T 292/438; Y10S 292/38; A47B 88/50; A47B 88/57

See application file for complete search history.

(56) References Cited

U.S. PATENT DOCUMENTS

| | | | | |
|---|---|---|---|---|
| 1,046,336 A | | 12/1912 | Schatz | |
| 3,850,463 A | | 11/1974 | Hawkins | |
| 4,139,249 A | * | 2/1979 | Hillman | E05B 65/0014 292/87 |
| D265,969 S | | 8/1982 | Koessler | |
| 4,416,477 A | | 11/1983 | Bialobrezki et al. | |

(Continued)

FOREIGN PATENT DOCUMENTS

| | | | | |
|---|---|---|---|---|
| DE | 29 32 123 A1 | | 2/1981 | |
| DE | 10217049 A1 | * | 11/2003 | E05B 65/0014 |
| FR | 2 885 635 A1 | | 11/2006 | |

OTHER PUBLICATIONS

U.S. Appl. No. 29/752,072, filed Sep. 24, 2020, Marsden.

(Continued)

*Primary Examiner* — Christine M Mills
*Assistant Examiner* — Peter H Watson
(74) *Attorney, Agent, or Firm* — Wolf, Greenfield & Sacks, P.C.

(57) ABSTRACT

Latch assemblies to secure a door, drawer, or other enclosure are disclosed. An assembly may include a latch and a catch. A latch arm is bendable to transition between an engaging position and a disengaged position. The latch may include a curved flexible support to provide a desired resistance to bending of the latch arm, and the flexible support may be vertically separated from the latch arm. The latch may be made of a unitary piece.

13 Claims, 7 Drawing Sheets

(56) References Cited

U.S. PATENT DOCUMENTS

| | | | | |
|---|---|---|---|---|
| 4,715,628 | A | 12/1987 | Brink et al. | |
| 4,717,184 | A | 1/1988 | Boyce | |
| 5,147,099 | A | 9/1992 | McLinden et al. | |
| D375,247 | S | 11/1996 | Gandhi | |
| 5,626,372 | A * | 5/1997 | Vogt | E05B 65/0014 292/87 |
| 5,645,304 | A | 7/1997 | Richardson et al. | |
| 6,481,811 | B1 | 11/2002 | Marsh | |
| D495,944 | S | 9/2004 | Winig et al. | |
| 6,942,257 | B2 | 9/2005 | Wong et al. | |
| D604,701 | S | 11/2009 | Hemmi et al. | |
| D639,137 | S | 6/2011 | Ray, II | |
| D759,475 | S | 6/2016 | Banno | |
| 10,208,510 | B1 | 2/2019 | Van Dyck | |
| D904,177 | S | 12/2020 | Peck et al. | |
| D924,675 | S | 7/2021 | Potter et al. | |
| 2003/0048050 | A1 | 3/2003 | Wong et al. | |
| 2009/0066203 | A1 * | 3/2009 | Zielinski | E05B 65/46 292/1 |
| 2014/0159389 | A1 | 7/2014 | Perche | |
| 2014/0312635 | A1 * | 10/2014 | Hansen | E05C 17/54 292/343 |
| 2018/0023323 | A1 | 1/2018 | Anderson | |
| 2019/0085594 | A1 | 3/2019 | Anderson | |
| 2019/0249461 | A1 | 8/2019 | Herskovitz | |

OTHER PUBLICATIONS

EP21020476.4, Feb. 25, 2022, Extended European Search Report. Extended European Search Report for European Application No. 21020476.4, dated Feb. 23, 2022.

* cited by examiner

LATCH ASSEMBLY TO SECURE OPENING OF AN ENCLOSURE

FIELD

Disclosed embodiments relate to latch assemblies, for example, safety latch assemblies designed to impede the opening of a drawer or a cabinet door.

DESCRIPTION OF THE RELATED ART

Latch assemblies are known to help prevent doors, such as cabinet doors, drawers, or other enclosures from being opened by children or pets. In some instances, a latch may be installed on a cabinet door and aligned with a catch that is installed on an inside of cabinet such that the latch engages with the catch when someone attempts to open the door. This arrangement can impede a child or pet from opening the cabinet door. To open the door, an adult opens the door slightly, moves the latch from a default engaging position (e.g., the position described above), to a disengaged position, allowing the adult to fully open the door.

SUMMARY

According to one embodiment, a latch assembly includes a latch having a base configured to be connected to a first surface, a latch arm, a latch engagement portion positioned on the latch arm, and a flexible support fixedly connected to the base and connected to the latch arm. The latch arm may have a proximal region connected to the base. Further, the flexible support may include a curved portion, and the flexible support may be spaced from the latch arm along at least a portion of the flexible support. The flexible support may also be configured such that when the latch is connected to the first surface, applying a force on the latch arm in a direction toward the flexible support bends the flexible support such that the latch engagement portion moves.

According to another embodiment, a latch assembly includes a latch having a latch base configured to be connected to a first surface, a latch arm including a proximal portion connected to the latch base at a latch arm-base connection location, a latch engagement portion positioned on the latch arm, and a flexible bow support. The flexible bow support may have a first portion connected to the latch base at a bow-base connection location and may have a second portion connected to the latch arm at a bow-latch arm connection position. Further, the latch may have an engaging position. When the latch is in the engaging position, the latch arm-base connection location may be vertically spaced from the bow-base connection location of the flexible bow support by a first distance, and the latch engagement portion may be vertically spaced from the bow-base connection location by a second distance. The latch may also have a disengaged position. When the latch is in the disengaged position, the latch arm-base connection location may remain vertically spaced from the bow-base connection location by the first distance, and the latch engagement portion may be vertically spaced by a third distance from the bow-base connection location. In some instances, the third distance may be less than the second distance.

According to a further embodiment, a latch assembly includes a latch base, a latch arm including a proximal portion connected to the latch base, a flexible support including a curved portion, and a bend limiter attached to one of the latch arm and the flexible support. The bend limiter may be positioned between the latch arm and the flexible support. The flexible support may include a first portion connected to the latch base at a support-base connection location, and the flexible support may include a second portion connected to the latch arm at a support-latch arm connection position. The flexible support may be vertically spaced from the latch arm between the support-base connection location and the support-latch arm connection location. The latch arm and the flexible support may be configured to bend when a force is applied to the latch arm in the direction of the flexible support. Further, the bend limiter may be configured to contact the other of the latch arm and the flexible support when the latch arm and flexible support bend in response to an application of force to the latch arm in the direction of the flexible support.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1:
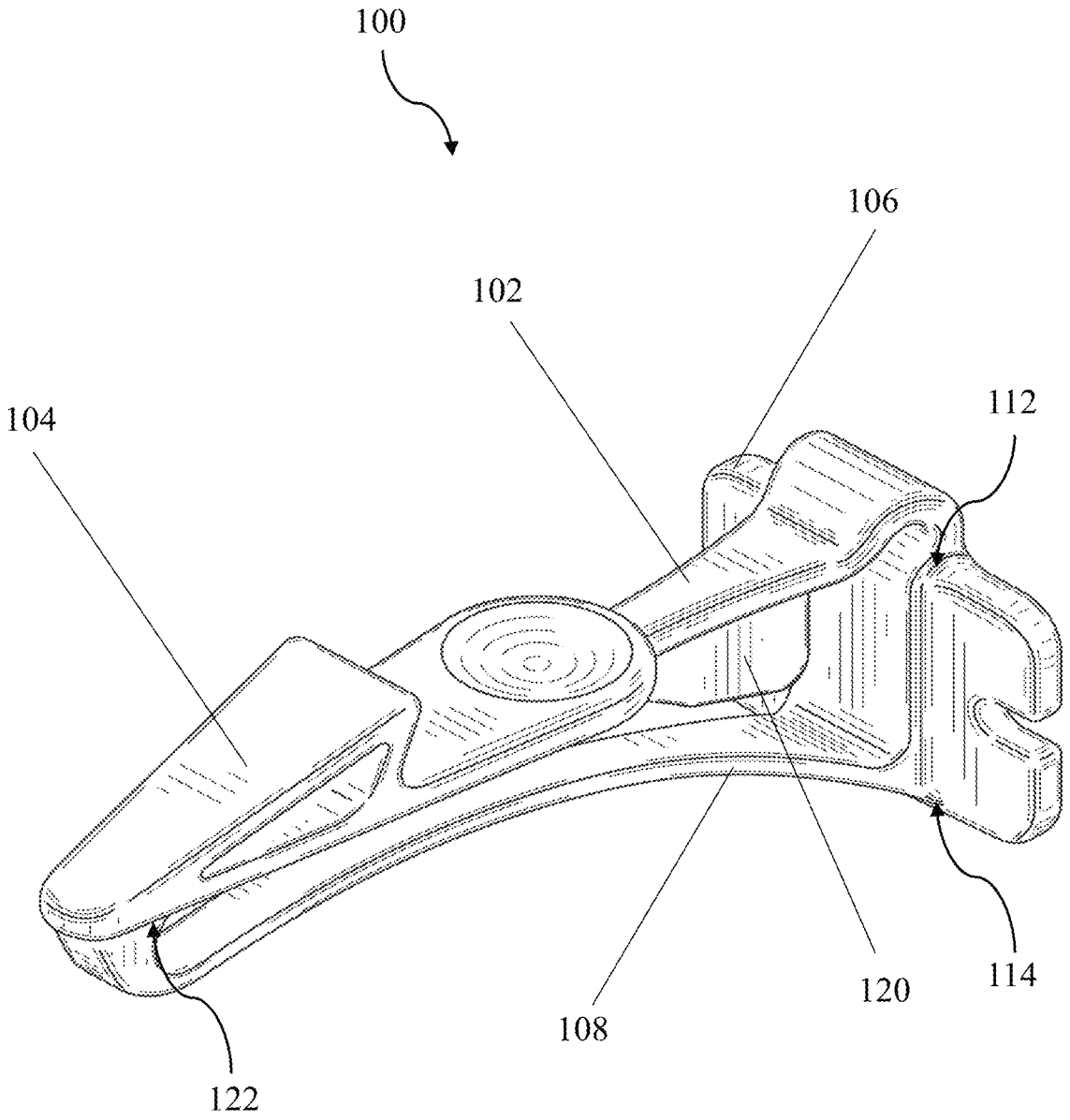
FIG. 1 is a perspective view of a latch according to one illustrative embodiment.

In some conventional cabinet and drawer latches, a larch arm is connected to a base, and the arm includes a latch engagement portion configured to engage with a corresponding catch. The latch is arranged such that a user presses on the latch arm to bend the arm to move the latch engagement portion a disengaged position where the latch arm does not engage the corresponding catch when the cabinet door or drawer is opened. The amount of force required to sufficiently bend the latch arm to move the latch engagement portion a sufficient distance to reach the disengaged position depends on the material and geometry of the latch arm, as well as the geometry of the connection of the latch arm to the base. In some circumstances, manufacturing the latch to have a precise threshold force at which the arm bends sufficiently to have the latch engagement portion clear the catch can be difficult because of manufacturing tolerances and the sensitivity of the device to the connection of the latch arm to the base. For example, in an injected molded latch, if the area at the boundary where the latch arm and the base intersect has a slightly different radius of curvature than intended due to manufacturing variances, the threshold force could be noticeably different than intended.

The potential energy stored in the bent latch arm biases the latch toward the engaging position such that when no user is pressing on the latch arm, the latch engagement portion is positioned to engage with the catch if the cabinet door (or drawer) is pulled in an attempt to open.

Some conventional cabinet and drawer latches include coil springs which are used to bias the latch arm toward the engaging position. While a coil spring may provide a repeatable bias force such that the threshold force for moving the latch arm to the disengaged position is predictable, such an arrangement may include one or more parts which may detach from the device if the device fails. Additionally, such latch arrangements may require numerous assembly steps during manufacture.

When using latch assemblies, a user may push too hard on the latch arm such that the latch arm overly bends, and the latch arm breaks at the connection to the base. Strengthening the connection between the latch arm and the base may result in a bending stiffness which is overly difficult to overcome when trying to bend the latch arm to move the latch engagement portion to the disengaged position.

According to embodiments disclosed herein, a latch assembly includes a latch arm in combination with a flexible support. Both the latch arm and the flexible support may be attached to a latch base. The flexible support may be spaced a distance below the latch arm (when the latch is installed and oriented in a way that a user presses downwardly to move the arm into the disengaged position). When the latch is installed and oriented such that a user pushes sideways to release the latch, the flexible support may be positioned on the side of the latch toward which the user pushes, and the flexible support may be spaced a distance from the latch arm.

The flexible support is curved in some embodiments to form an arc. The curved support may act as a spring such that the flexible support biases the latch arm toward an engaging position, e.g., upwardly, in a typical installation orientation. When a user presses downwardly on the latch arm, the flexible support bends but provides resistance. The flexible support can be constructed and arranged such that a downward force of at least a threshold force is required to move the latch to a disengaged position. For purposes herein, a "bow support" refers to a flexible support which is curved for the entire length of the flexible support between its connection points.

By providing a flexible support for the latch arm where the flexible support provides a significant portion of the resistance to bending, the geometry of the latch arm may be adapted specifically for resistance to pull forces in the longitudinal direction. For example, an industry standard may require that a latch assembly be able to withstand a pull force of 50 lbf on a cabinet door without failing. When someone pulls on the cabinet door with the latch arm in the engaging position, the latch engagement portion engages with and pulls on the catch. One possible mode of failure is the latch arm breaking due to strain. In some embodiments, the latch arm and the connection of the latch arm to the latch base may be designed to withstand a certain pull force (e.g., up to and including 50 lbf) while not having to rely entirely on the latch arm's bending characteristics to provide bend resistance because the flexible support may be arranged to provide a significant portion of the bending resistance that affects the threshold force required to bend the latch arm to a disengaged position.

The flexible support may provide a more robust and predictable bending resistance as compared to a latch assembly that includes only a latch arm directly connected to a base. Less stress may be focused at the connection point of the latch arm to the base according to embodiments disclosed herein as compared to a latch assembly that includes only a latch arm directly connected to a base. Additionally, the flexible support may be attached to the base at an acute angle, rather than perpendicular to the base, to provide greater support through the length of the support.

According to a further aspect, the use of a flexible support to provide bending resistance may permit the connection of the latch to the base to be formed in a different manner than conventional latches. For example, the connection of the latch arm to the base may be specifically designed to have a geometry which reduces the presence of stress concentrations.

According to another aspect of embodiments disclosed herein, a latch maybe constructed as a unitary piece of material. For example, latches disclosed herein may be formed of injection molded plastic made in a single mold. In such embodiments, the latch may provide an advantage of avoiding the formation of small pieces that fall from the device if the device fails under stress. In some embodiments, the latch arm, the latch engagement portion, and the flexible support may be formed as a single unitary piece. Other pieces may be added to the single unitary piece in some embodiments. In some embodiments, the entire latch of the latch assembly may be formed of a single unitary piece, with the catch being formed as a separate piece.

The arrangements of the embodiments disclosed herein provide the ability to attain various threshold forces and/or resistances to pull forces by using different geometries, thicknesses, materials, and/or other properties for the flexible support, the latch arm, and/or other components of the latch assembly.

In some embodiments, the latch arm is fixedly connected to the base, as described above. When the latch arm is fixedly connected to the base, the point of connection between the latch arm and the base remains approximately in the same location even when a force is applied to the latch arm as described above. That is, the proximal end of the latch arm does not slide or otherwise translate relative to the base.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIGS. 1-4 show various views of an illustrative embodiment of a latch 100 according to the present disclosure. In some embodiments, latch 100 includes a latch arm 102, a latch engagement portion 104, a base 106, and a flexible support 108. Latch arm 102 may be operatively connected to base 106 at a first end of latch arm 102 at a latch arm-base connection position 112. Latch engagement portion 104 may be positioned within a distal region of latch arm 102. In some instances, latch engagement portion 104 may be located at a second end of latch arm 102 opposite the first end. Flexible support 108 may connect to the second end of latch arm 102 at a support-latch arm connection position 122 which may be positioned in a distal region of the latch arm, or may be positioned at a distal end of the latch arm. Flexible support 108 may connect to base 106 at a support-base connection position 114.

Flexible support 108 may be connected to a bottom portion of base 106, while latch arm 102 may be connected to a top portion of base 106. Though latch arm-base connection position 112 and support-base connection position 114 are shown to be located at different positions on base 106, this need not be the case, as in some embodiments, latch arm-base connection position 112 and support-base connection position 114 may be located at the same position. In some embodiments, the support base connection position is the lowermost portion of the connection surface between the support and the base. In alternative embodiments, two separate base pieces may be provided to form a base for the latch. For example, the latch arm may be attached to a first base piece, and the flexible support may be attached to a second base piece. The first and second base pieces may be separate from one another, other than being connected indirectly through the remainder of the latch, yet still be considered to be a base for the latch.

Latch 100 may be manufactured in any suitable manner. In some instances, it may be desirable to manufacture latch 100 as a single piece. In such instances, Latch 100 may be formed by casting, molding, 3D printing, or any other suitable manufacturing method. The components of latch 100 may be made from polypropylene (e.g., P66 Polypropylene), polyvinyl chloride, polyethylene, or any other suitable material. The components of latch 100 may alternatively be formed separately in some embodiments. In some embodiments, components may be formed by casting, molding, 3D printing, or any other suitable manufacturing method, and then assembled. The components may be fastened to one another using resin, epoxy, or fasteners.

Figure 3:
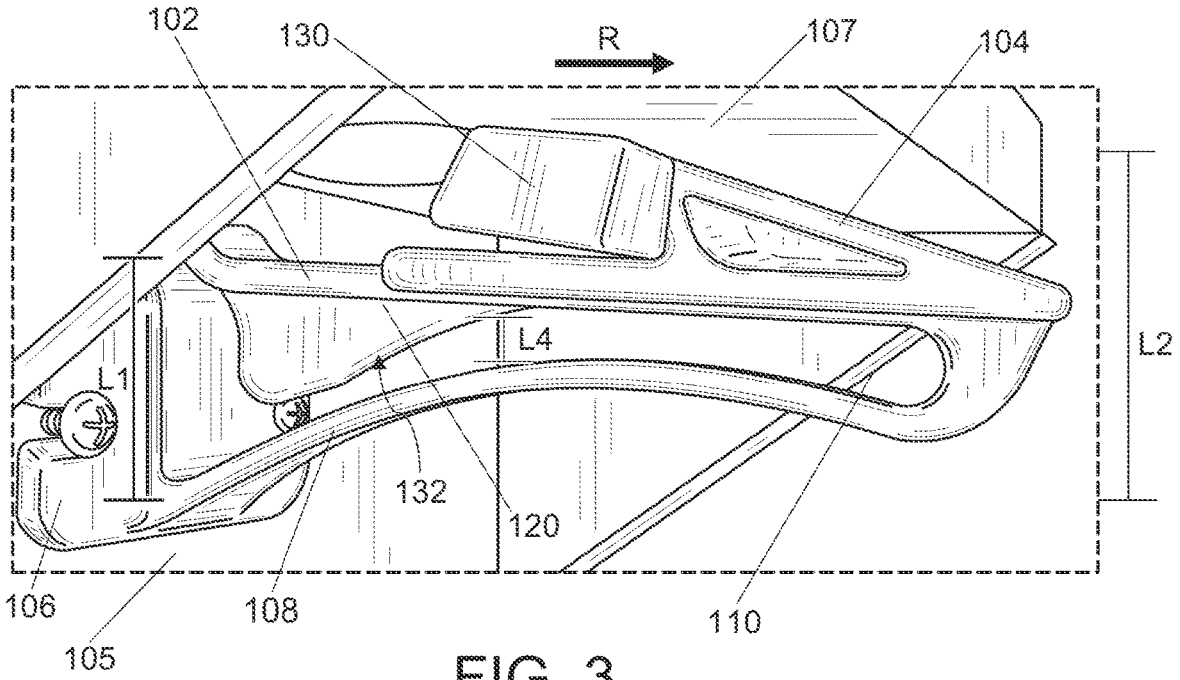
FIG. 3 is a side view of a latch assembly including a latch and a catch, with the latch in an engaging position, according to one exemplary embodiment.
Figure 4:
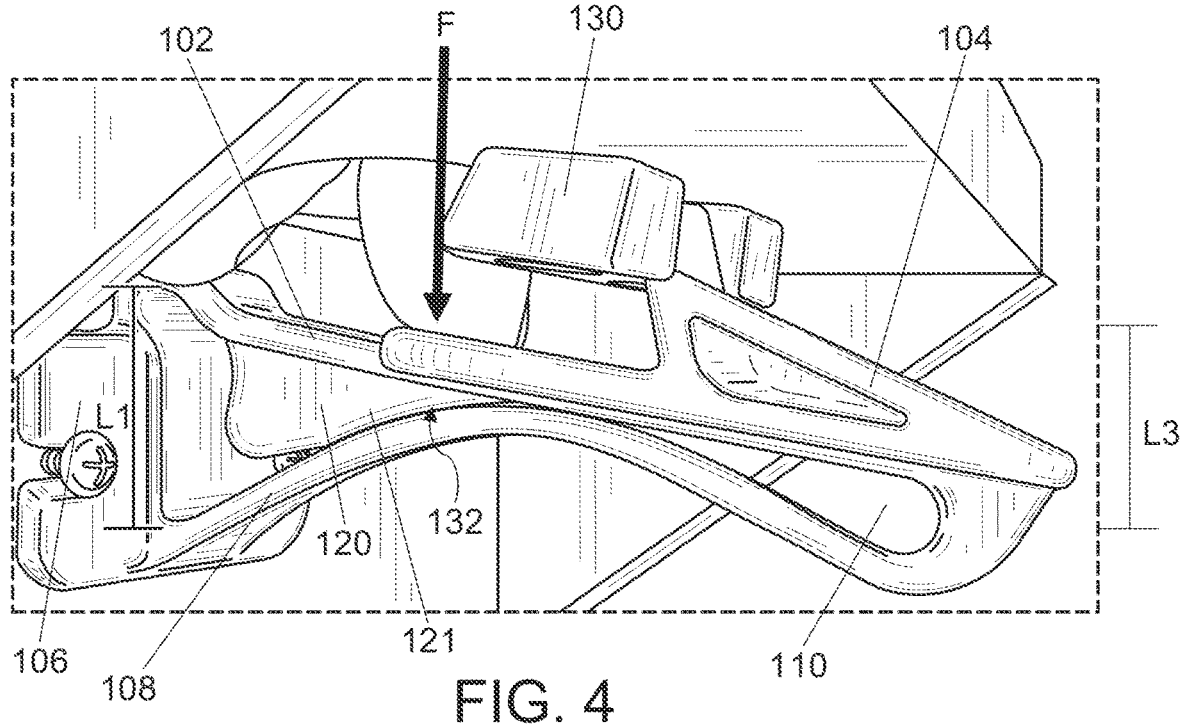
FIG. 4 is a side view of the latch assembly shown in FIG. 3, with the latch in a disengaged position, according to one exemplary embodiment.

FIGS. 3-4 are side views of latch 100 in an engaging position and disengaged position respectively. In some embodiments, latch 100 is attached to a first surface 105 via base 106, as described above, and a catch 130 is attached to a second surface 107 such that catch 130 prevents latch engagement portion 104 from moving beyond catch 130 when either of the first and second surfaces is moved relative to the other of the first and second surfaces, as shown in FIG. 3. When catch 130 and latch engagement portion 104 are arranged such that latch arrangement portion 104 may not move beyond catch 130, latch 100 is in the engaging position. In such a position, a cabinet door or drawer to which the latch is mounted is inhibited from opening.

In some embodiments, latch 100 may be constructed to bend from the engaging position to a disengaged position. In the disengaged position, as shown in FIG. 4, latch engagement portion 104 is positioned such that latch engagement portion 104 may move beyond catch 130 when the door or drawer is moved in an opening direction.

In some applications, latch 100 may be configured such that the latch engagement portion 104 reaches a disengaged position when acted upon by a force that meets or exceeds a threshold force F, as shown in FIG. 4.

In some embodiments, in the engaging position, the support-base connection position 114 and the latch arm-base connection position 112 are separated by a first vertical distance L1. Further, in the engaging position, a top of latch engagement portion 104 is vertically spaced from support-base connection position 114 by a second vertical distance, L2. When latch 100 bends under a threshold force F (e.g., into the disengaged position), the vertical spacing between support-base connection position 114 and the latch arm-base connection position 112 remains at approximately the distance of L1, while the vertical spacing between support-base connection position 114 and the latch engagement portion decreases to a third distance L3. For purposes herein, the vertical spacing between the latch engagement portion 104 and support-base connection position 114 (e.g., distances L2, L3) may be measured from the topmost portion of latch engagement portion 104.

Latch 100 may be constructed and arranged to have a first vertical distance L1 of any suitable value. For example, in various embodiments, first vertical distance L1 may be 1 inch or at least 1 inch, 1.3 inches or at least 1.3 inches, 1.6 inches or at least 1.6 inches, 2 inches or at least 2 inches, or any other suitable value. Further, in various embodiments, first vertical distance L1 may be less than 3 inches, less than 2.5 inches, less than 2.2 inches, or any other suitable value. Combinations of the above referenced ranges are also contemplated. For example, first vertical distance L1 may be between 1 inch and 3 inches inclusive, between 1.3 inches and 2.5 inches inclusive, or between 1.6 inches and 2.2 inches inclusive. First vertical distance L1 may take on other suitable values or ranges, depending on the application.

Latch 100 may be constructed and arranged to have a second vertical distance L2 of any suitable value. For example, in various embodiments, second vertical distance L2 may be 1 inch or at least 1 in, 1.5 inches or at least 1.5 inches, 2 inches or at least 2 inches, 2.5 inches or at least 2.5 inches, or any other suitable value. Further, in various embodiments, second vertical distance L2 may be less than 4 inches, less than 3.5 inches, less than 3 inches, or any other suitable value. Combinations of the above referenced ranges are also contemplated. For example, second vertical distance L2 may be between 1 inch and 4 inches inclusive, between 1.5 inches and 3.5 inches inclusive, or between 2 inches and 3 inches inclusive. Second vertical distance L2 may take on other suitable values or ranges, depending on the application.

Latch 100 may be constructed and arranged to have a third vertical distance L3 of any suitable value. For example, in various embodiments, third vertical distance L3 may be 0.5 inches or at least 0.5 inches, 1 inch or at least 1 inch, 1.3 inches or at least 1.3 inches, 1.5 inches or at least 1.5 inches, or any other suitable value. Further, in various embodiments, third vertical distance L3 may be less than 2.5 inches, less than 2.3 inches, less than 2 inches, or any other suitable value. Combinations of the above referenced ranges are also contemplated. For example, third vertical distance L3 may be between 0.5 inches and 2.5 inches inclusive, between 1 inch and 2.3 inches inclusive, or between 1.5 inches and 2 inches inclusive. Third vertical distance L3 may take on other suitable values or ranges, depending on the application.

Latch 100 may be constructed and arranged to have a threshold force F of any suitable value. For example, in various embodiments, threshold force F may be 1 lbf or at least 1 lbf, 5 lbf or at least 5 lbf, 10 lbf or at least 10 lbf, 11 lbf or at least 11 lbf, 11.5 lbf, or any other suitable value. Further, in various embodiments, the threshold force may be less than 20 lbf, less than 15 lbf, less than 12 lbf, or any other suitable value. Combinations of the above referenced ranges are also contemplated. For example, threshold force F may be between 1 lbf and 20 lbf inclusive, between 5 lbf and 15 lbf inclusive, between 10 lbf and 15 lbf, inclusive between 5 lbf and 11 lbf inclusive, between 10 lbf and 20 lbf inclusive, or between 10 lbf and 12 lbf inclusive. Threshold force F may take on other suitable values or ranges, depending on the application.

In some embodiments, latch 100 includes a bend limiter 120. Bend limiter 120 may be connected to latch arm 102 such that bend limiter 120 deters latch arm 102 from bending beyond a threshold angle. In this manner, the bend limiter and the flexible support may help prevent the latch arm from bending too far and breaking. In some embodiments, bend limiter 120 contacts flexible support 108 once latch arm 102 bends by a certain angle, for example, an angle slightly larger than the angle required to go from the engaging position to the disengaged position. In other embodiments, bend limiter 120 may be positioned to contact latch arm 102 prior to the latch engagement portion reaching the disengaged position.

FIG. 4 shows bend limiter 120 contacting flexible support 108. Prior to this contact being made, the force applied to the latch arm (see arrow F) is applied to the flexible support at the support-latch arm connection point, which is located at a distal region of the flexible support. Once contact is made between bend limiter 120 and flexible support 108, the force on the flexible support is closer to the base, and the resistance to bending increases.

In some embodiments, latch 100 includes a space 110 between latch arm 102 and flexible support 108. Bend limiter 120 may be disposed within space 110. For example, bend limiter 120 may be attached to, and extend downwardly from, latch arm 102 at a location distal to base 106. Bend limiter 120 may be vertically displaced from flexible 108 by a fourth vertical distance L4 when latch 100 is in the engaging position. Thus, as latch 100 transitions from the engaging position to the disengaged position, bend limiter 120 may contact flexible support 108 with a contact edge 121, as shown in FIG. 4. When bend limiter 120 contacts flexible support 108, bend limiter 120 increases the resistance to the bending of latch arm 102 by bracing against flexible support 108. In this manner, bend limiter 120 may serve to limit the angle by which latch arm 102 may bend when acted upon by a threshold force F.

Latch 100 may be constructed and arranged to have a fourth vertical distance L4 of any suitable value. For example, in various embodiments, fourth vertical distance L4 may be 0.2 inches or at least 0.2 inches, 0.4 inches or at least 0.4 inches, 0.6 inches or at least 0.6 inches, 0.8 inches or at least 0.8 inches, or any other suitable value. Further, in various embodiments, fourth vertical distance L4 may be less than 1.4 inches, less than 1.2 inches, less than 1 inch, or any other suitable value. Combinations of the above referenced ranges are also contemplated. For example, fourth vertical distance L4 may be between 0.2 inches and 1.4 inches inclusive, between 0.4 inches and 1.2 inches inclusive, or between 0.6 inches and 1 inch inclusive. Fourth vertical distance L4 may take on other suitable values or ranges, depending on the application.

Limiting the bending range of latch arm 102 may serve to prevent premature wear to latch 100, increasing the longevity of latch 100. Bend limiter 120 is not limited to the shape and/or relative size shown in the illustrated embodiments. The bend limiter, if present, may have any suitable shape and size.

In some embodiments, bend limiter 120 may contain a partially curved surface 132. Partially curved surface 132 may be shaped to match or approximately match the curve of flexible support 108. In this manner, as bend limiter 120 makes contact with flexible support 108, partially curved surface 132 contacts a length of flexible support 108, as shown in FIG. 4. In other embodiments, a bend limiter may be shaped such that the bend limiter contacts the flexible support at a single point or multiple points rather than along a length of the flexible support.

In some embodiments, bend limiter 120 may be thinner than latch arm 102. In such embodiments, latch 100 may be more easily formed via injection molding due to the thickness difference between bend limiter 120 and latch arm 102.

In some embodiments, bend limiter 120 may be formed with latch 100 as a unitary piece. Bend limiter 120 may be made of polypropylene (e.g., P66 Polypropylene), polyvinyl chloride, polyethylene, or any other suitable material. In some embodiments, bend limiter 120 is made of the same material as other components of latch 100, while in other embodiments, bend limiter 120 is made of different materials from the remaining components of latch 100.

Figure 7:
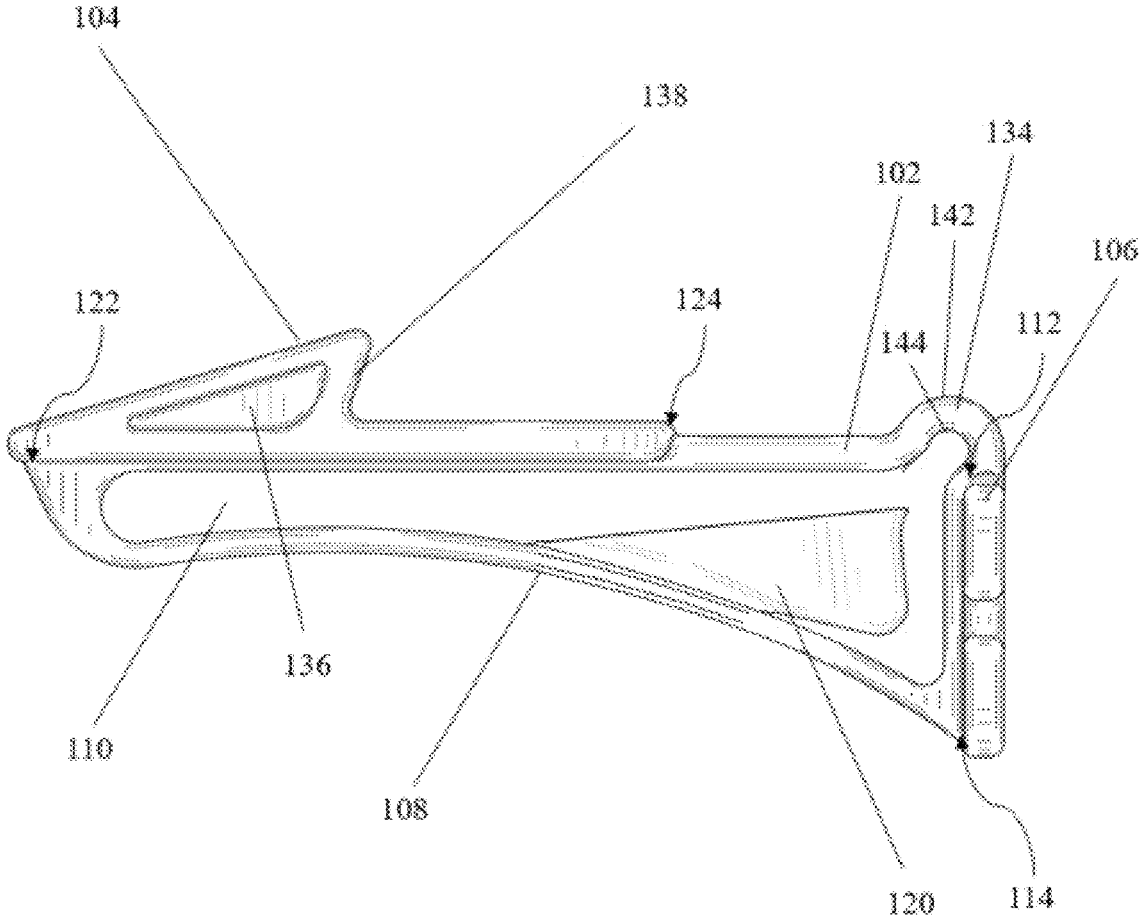
FIG. 7 is a side view of a latch according to one illustrative embodiment.

According to some embodiments, a bend limiter may be attached to the flexible support instead of the latch arm, as shown in FIG. 7. For example, bend limiter 120 may extend upwardly from flexible support 108 and be spaced from an underside of latch arm 102 when the latch is in the engaging position.

The use of a latch arm in combination with a flexible support which is separated from the latch arm allows the use of the bend limiter. With this arrangement, the latch arm may be initially bent with a first user force, for example to reach a disengaged position, and once the bend limiter makes contact, the user force required for further bending increases.

Figure 2:
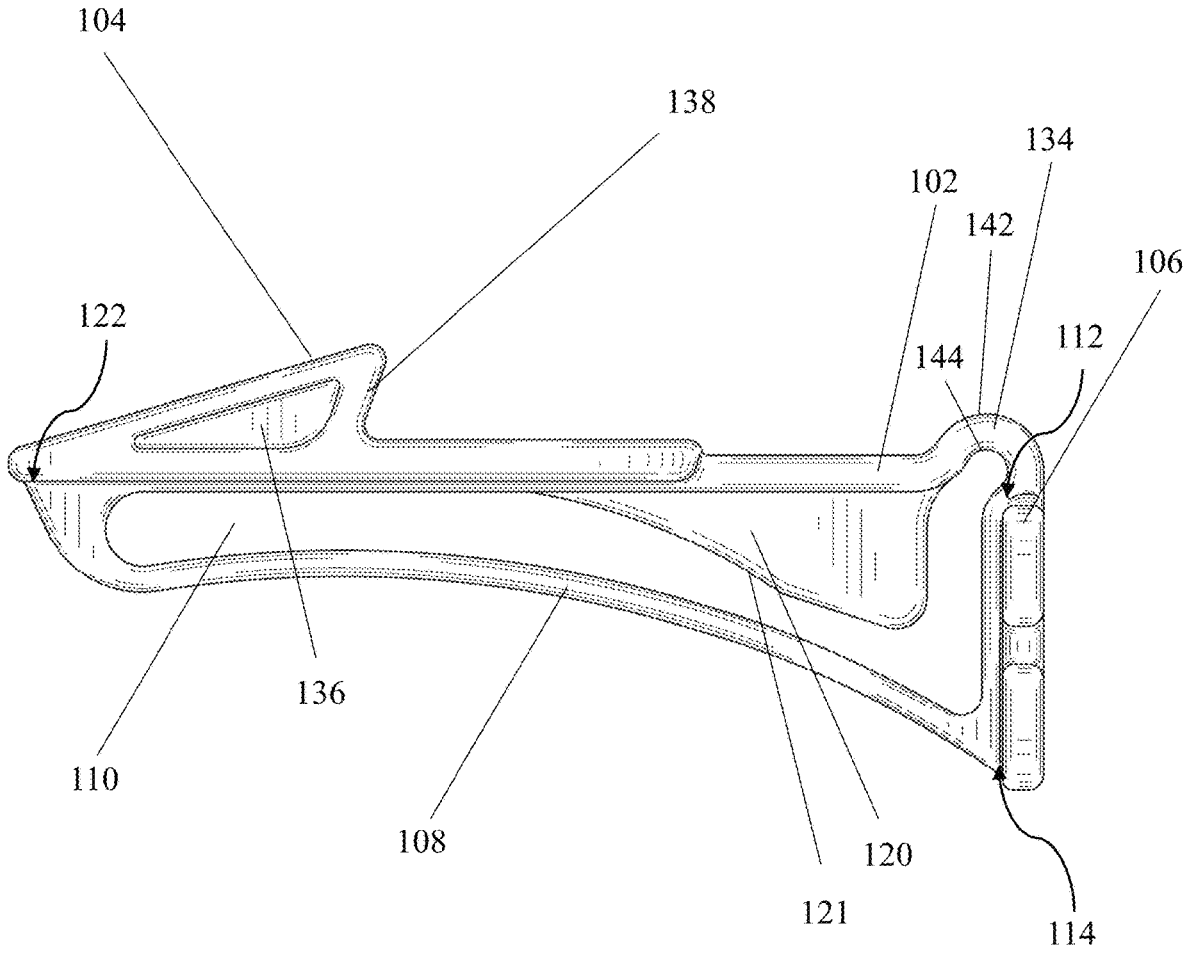
FIG. 2 is a side view of a latch according to one illustrative embodiment.

By employing a flexible support, latch 100 may include additional features which otherwise may be difficult to incorporate. For example, in some embodiments, latch 100 may include a curved attachment of the latch arm to the base. As shown in FIG. 2, a curved member 134 connects latch arm 102 to base 106. The curved member 134 is shown as initially extending vertically from a top surface of base 106, though any suitable arrangement may be used. For example, curved member 134 may extend upwardly at angle from base 106, such as at an angle of forty-five degrees relative to horizontal. Curved member 134 may include a top surface 142 and a bottom surface 144, each of which may be curved along a length of curved member 134, as shown in FIG. 2.

The curved shape of curved member 134 may limit stress concentrations on latch arm 102. For example, curved member 134 may be shaped as a partial circle to reduce the presence of corners and/or small radii of curvature associated with the connection of the latch arm to the base. The use of curved portions may serve to reduce the risk that latch arm 102 may fail during bending. By using flexible support 108 (and optionally, bend limiter 120) to resist bending of latch arm 102, the connection of latch arm 102 to base 106 does not necessarily need to provide as much bend stiffness as found in conventional latches. As such, the use of a curved member 134 is possible.

As described above, when a child attempts to open a cabinet, a drawer, or other enclosure outfitted with latch 100, latch engagement portion 104 contacts catch 130 to prevent the cabinet, drawer, or other enclosure from opening. The force on the cabinet may apply a force along the longitudinal direction of the latch arm. When latch engagement portion 104 contacts catch 130, the latch engagement portion 104 may apply a force onto catch 130 which approximately equal to the force being applied on the cabinet, drawer, or enclosure. In turn, catch 130 applies a reaction force R on latch engagement portion 104 of latch 100.

The latch assembly may be constructed and arranged to resist such a reaction force R up to a specified value. For example, according to some standards, the latch assembly may be required to resist a reaction force of up to 50 lbf. In some embodiments the latch may be adapted to resist a reaction forces of up to and including 50 lbf. In some embodiments, the latch may be adapted to resist reaction force of up to and including 60 lbf. The latch may be adapted to resist reaction forces of up to other values as well.

In some embodiments, flexible support 108 may include a curved portion. The curved portion may be able to store energy so as to resist a force applied to the latch arm and provide a bias which urges the latch arm back toward an engaging position. In this manner, the flexible support may be referred to as a spring support. In some embodiments, as shown in FIGS. 1-4, the entirety of flexible support 108 may be curved between the connection locations of the flexible support.

Flexible support 108 may extend longitudinally from the latch base at an upward angle. For example, the longitudinal direction of the flexible support may form an angle of sixty degrees with a vertical face of the latch base (e.g., rear face and/or front face) at the proximal end of the flexible support just distal to any strain-relieving curvature at the connection of the flexible arm to the base. The angle may be between fifty-five and sixty-five degrees in some embodiments, between fifty and seventy degrees in some embodiments, or any other suitable angle. As the flexible support travels distally away from the base, the angle formed between a vertical face and a tangent to top of the flexible support may increase. In some embodiments, as the flexible support travels distally away from the base, the angle formed between a vertical face and a tangent to bottom of the flexible support may increase. In some embodiments, such as the embodiment shown in FIG. 2, the angle can exceed ninety degrees in a region near the connection of the flexible support to the latch arm such that the flexible support is angled downwardly along a portion of the flexible support. In some embodiments, latch engagement portion 104 has a triangular shape when viewed from the side. In some embodiments, latch engagement portion 104 may have a length approximately equal to one-third of the length of latch arm 102, though this need not be the case. In some embodiments, the length of latch engagement portion 104 may be greater than one-third of the length of latch arm 102 or less than one-third of the length of latch arm 102, depending on the application.

The latch engagement portion 104 may have an engagement surface 138 which is angled toward the associated catch to form an acute angle with the latch arm. The catch also may have an angled engagement surface 140. Such an arrangement may aid in keeping the latch engagement portion 104 engaged with the catch when a large force is applied in the longitudinal direction. Engagement surface 138 and engagement surface 140 may be angled such that the two surfaces have the same angle when the two surfaces contact one another such that the two surfaces contact one another across substantially their entire surfaces.

In some embodiments, latch engagement portion 104 includes one or more depressions 136. Depressions 136 may serve to facilitate manufacturing latch 100. Particularly, depressions 136 may allow for latch 100 to be more easily manufactured via injection molding as a single piece.

Figure 5:
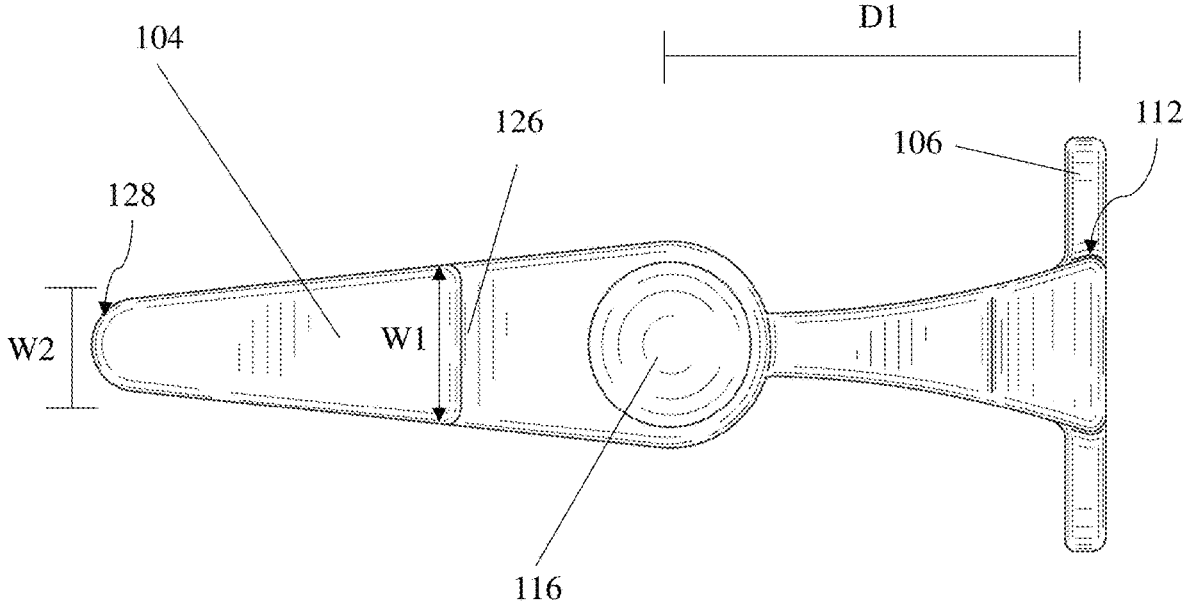
FIG. 5 is a top view of a latch according to one illustrative embodiment.

As shown in FIG. 5, in some embodiments, latch 100 may include a push area including a depression 116. Depression 116 may provide a visual cue to a user as to where to apply a force to the latch arm. In some embodiments, a push area may be provided without a depression or other visual cue. A distance D1 from the push area to base-latch arm connection position 112 plays a role in the threshold force F required to bend the latch arm to a disengaged position. The closer that the push area is to base-latch arm connection position 112 (smaller D1), the more force that is required to generate a torque sufficient to bend latch 100 by predetermined distance L2-L3.

Latch 100 may be constructed and arranged to have a distance D1 of any suitable value. For example, in various embodiments, distance D1 may be 1.5 inches or at least 1.5 inches, 2 inches or at least 2 inches, 2.5 inches or at least 2.5 inches, or any other suitable value. Further, in various embodiments, distance D1 may be less than 4 inches, less than 3.5 inches, less than 3 inches, or any other suitable value. Combinations of the above referenced ranges are also contemplated. For example, distance D1 may be between 1.5 inches and 4 inches inclusive, between 2 inches and 3.5 inches inclusive, or between 2.5 inches and 3 inches inclusive. Distance D1 may take on other suitable values or ranges, depending on the application.

Referring to FIG. 5, in some embodiments, latch engagement portion 104 includes two ends: a first end 126 positioned to face toward base 106 and a second end 128 positioned to face away from base 106. Latch engagement portion 104 may have a first width W1 at first end 126 and a second width W2 at second end 128. In some embodiments, such as the embodiment of FIG. 5, first width W1 is greater than second width W2. However, this need not be the case, as second width W2 may be greater than first width W1, depending on the application.

Latch 100 may be constructed and arranged to have first and second widths W1, W2 of any suitable value. For example, in various embodiments, first and second widths W1, W2 may be 0.5 inches or at least 0.5 inches, 1 inch or at least 1 inch, 1.5 inches or at least 1.5 inches, or any other suitable value. Further, in various embodiments, first and second widths W1, W2 may be less than 3 inches, less than 2.5 inches, less than 2 inches, or any other suitable value. Combinations of the above referenced ranges are also contemplated. For example, first and second widths W1, W2 may be between 0.5 inches and 3 inches inclusive, between 1 inch and 2.5 inches inclusive, or between 1.5 inches and 2 inches inclusive. First and second widths W1, W2 may take on other suitable values or ranges, depending on the application.

Figure 6:
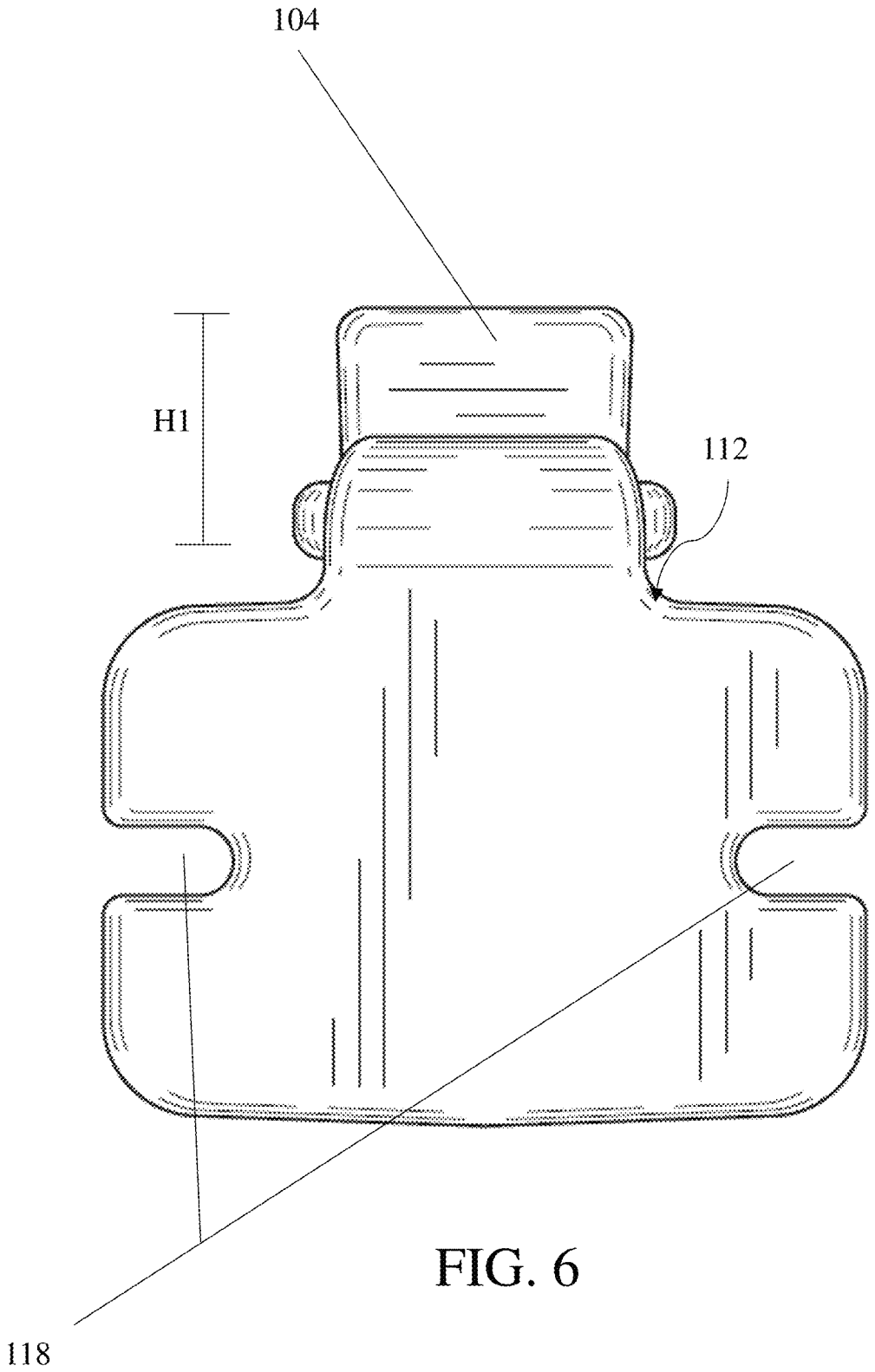
FIG. 6 is a rear view of a latch according to one illustrative embodiment.

As shown in FIG. 6, base 106 may serve to connect latch 100 to a suitable surface (e.g., a surface within a cabinet, a surface within a door, a wall, etc.). Thus, base 106 may include one or more fastener holes 118. Base 106 and fastener holes 118 may be constructed to accommodate large-headed fasteners (e.g., large headed screws) to robustly fix base 106 to a suitable surface. In some embodiments, fastener holes 118 may be fastened to the surface using screws, bolts, pins, or any other suitable fastener.

In some embodiments, latch engagement portion 104 may extend a height H1 vertically above the latch arm-base connection position 112. Height H1 may be arranged so that latch 100 interfaces with catch 130 as described above. In some embodiments, height H1 is 1.33 inches. Other heights H1 may be used in other embodiments of latch assemblies.

Figure 8:
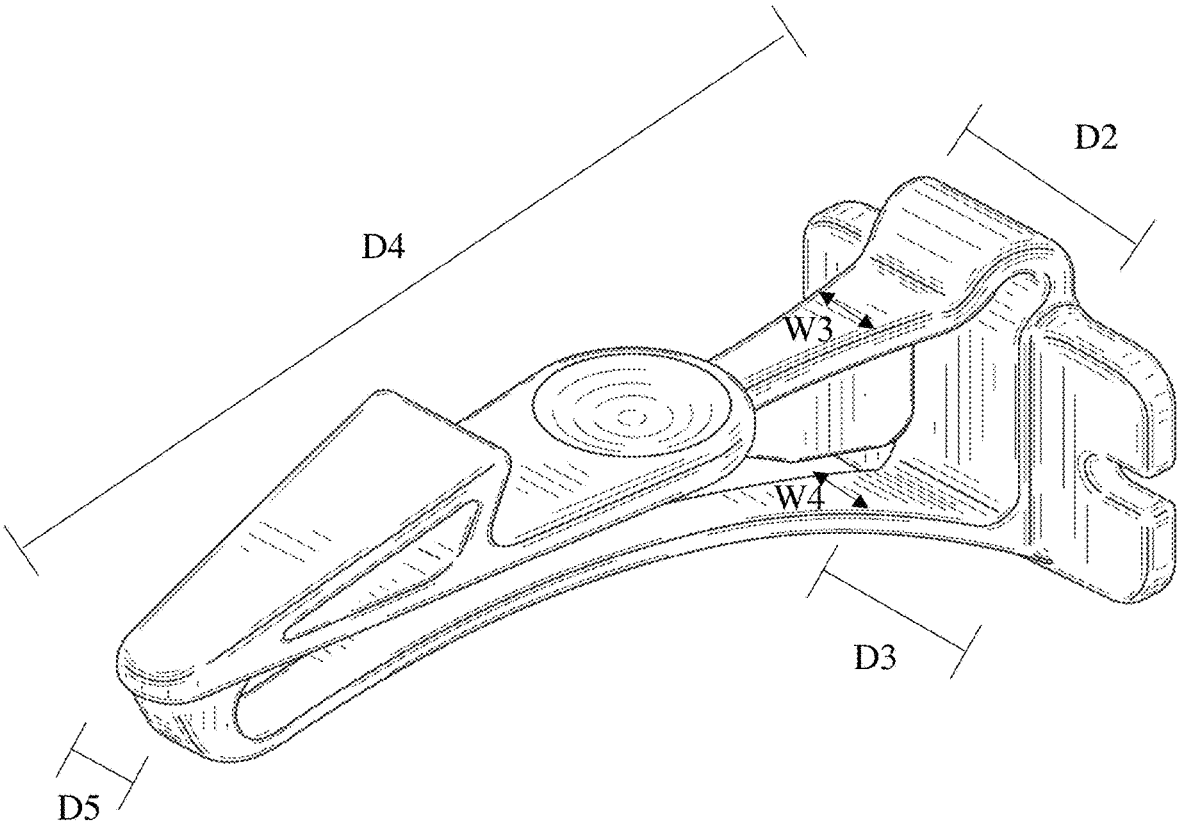
FIG. 8 is a perspective view of a latch according to one illustrative embodiment.

As shown in FIG. 8, latch 100 may be configured with a second distance D2, a third distance D3, a fourth distance D4, a fifth distance D5, a third width W3, and a fourth width W4.

Latch 100 may be constructed and arranged to have second and third distances D2, D3 of any suitable value. For example, in various embodiments, second and third distances D2, D3 may be 0.5 inches or at least 0.5 inches, 0.7 inches or at least 0.7 inches, 1 inch or at least 1 inch, or any other suitable value. Further, in various embodiments, second and third distances D2, D3 may be less than 2 inches, less than 1.5 inches, less than 1.2 inches, or any other suitable value. Combinations of the above referenced ranges are also contemplated. For example, second and third distances D2, D3 may be between 0.5 inches and 2 inches inclusive, between 0.7 inches and 1.5 inches inclusive, or between 1 inch and 1.2 inches inclusive. Second and third distances D2, D3 may take on other suitable values or ranges, depending on the application.

Latch 100 may be constructed and arranged to have a fourth distance D4 of any suitable value. For example, in various embodiments, fourth distance D4 may be 2 inches or at least 2 inches, 3 inches or at least 3 inches, 4 inches or at least 4 inches, or any other suitable value. Further, in various embodiments, fourth distance D4 may be less than 7 inches, less than 6 inches, less than 5 inches, or any other suitable value. Combinations of the above referenced ranges are also contemplated. For example, fourth distance D4 may be between 2 inches and 7 inches inclusive, between 3 inches and 6 inches inclusive, or between 4 inches and 5 inches inclusive. Fourth distance D4 may take on other suitable values or ranges, depending on the application.

Latch 100 may be constructed and arranged to have a fifth distance D5 of any suitable value. For example, in various embodiments, fifth distance D5 may be 0.2 inches or at least 0.2 inches, 0.4 inches or at least 0.4 inches, 0.6 inches or at least 0.6 inches, or any other suitable value. Further, in various embodiments, fifth distance D5 may be less than 1.2 inches, less than 1 inch, less than 0.8 inches, or any other suitable value. Combinations of the above referenced ranges are also contemplated. For example, fifth distance D5 may be between 0.2 inches and 1.2 inches inclusive, between 0.4 inches and 1 inch inclusive, or between 0.6 inches and 0.8 inches inclusive. Fifth distance D5 may take on other suitable values or ranges, depending on the application.

Latch 100 may be constructed and arranged to have third and fourth widths W3, W4 of any suitable value. For example, in various embodiments, third and fourth widths W3, W4 may be 0.2 inches or at least 0.2 inches, 0.4 inches or at least 0.4 inches, 0.6 inches or at least 0.6 inches, or any other suitable value. Further, in various embodiments, third and fourth widths W3, W4 may be less than 1.2 inches, less than 1 inch, less than 0.8 inches, or any other suitable value. Combinations of the above referenced ranges are also contemplated. For example, third and fourth widths W3, W4 may be between 0.2 inches and 1.2 inches inclusive, between 0.4 inches and 1 inch inclusive, or between 0.6 inches and 0.8 inches inclusive. Third and fourth widths W3, W4 may take on other suitable values or ranges, depending on the application.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

The embodiments described herein may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Further, some actions are described as taken by a "user." It should be appreciated that a "user" need not be a single individual, and that in some embodiments, actions attributable to a "user" may be performed by a team of individuals and/or an individual in combination with computer-assisted tools or other mechanisms.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A latch assembly comprising:

a latch base;

a latch arm including a proximal portion connected to the latch base at a latch arm-base connection location;

a flexible support including a curved portion, the flexible support including a first portion connected to the latch base at a support-base connection location, and the flexible support including a second portion connected to the latch arm at a support-latch arm connection location, wherein the support-base connection location is different from the latch arm-base connection location, and wherein the flexible support is vertically spaced from the latch arm between the support-base connection location and the support-latch arm connection location; and a bend limiter disposed on one of the latch arm and the flexible support, wherein the bend limiter, the latch arm and the flexible support are a unitary piece, and wherein the bend limiter is positioned between the latch arm and the flexible support such that the bend limiter is out of contact with the other of the latch arm and the flexible support when the latch arm and the flexible support are in a relaxed state;

wherein the latch arm and the flexible support are configured to elastically bend when a force is applied to the latch arm in the direction of the flexible support; and wherein the bend limiter is configured to contact the other of the latch arm and the flexible support when the latch arm and flexible support bend in response to an application of force to the latch arm in the direction of the flexible support to stop the elastic bending of the latch arm and flexible support beyond a threshold angle.

2. The latch assembly as in claim 1, wherein the latch arm extends perpendicular to the latch base.

3. The latch assembly as in claim 1, wherein the latch arm-base connection location comprises a curved member connecting the proximal portion of the latch arm to the latch base, wherein the curved member extends at an upward angle from the latch base and forms a partial circle between the latch base and the latch arm.

4. The latch assembly of claim 1, wherein the bend limiter is disposed on a bottom surface of the latch arm and extends downwardly toward the flexible support.

5. The latch assembly of claim 4, wherein a portion of the bottom surface of the bend limiter is parallel with the flexible support along the curved portion of the flexible support.

6. The latch assembly of claim 1, wherein the latch arm further includes a latch engagement portion disposed on a portion of the latch arm distal to the latch base, and wherein the latch arm is configured to receive the application of force at a location proximal to the latch engagement portion along the latch arm between the latch engagement portion and the latch arm-base connection location.

7. The latch assembly as in claim 6, further comprising a catch configured to be connected to a second surface, the catch having a catch engagement portion.

8. The latch assembly as in claim 7, wherein a force equal to or greater than a threshold force is required to be applied to the latch arm in a direction toward the flexible support to move the latch engagement portion a sufficient distance to reach a disengaged position relative to the catch.

9. The latch assembly as in claim 7, wherein the latch engagement portion has a latch engagement surface which forms an acute angle with the latch arm.

10. The latch assembly as in claim 7, wherein the latch engagement portion extends along approximately one-third of a length of the latch arm.

11. The latch assembly as in claim 1, wherein the flexible support is curved along its entire length.

12. The latch assembly as in claim 1, wherein the flexible support is connected to the latch base at a proximal end of the flexible support.

13. The latch assembly as in claim 12, wherein the flexible support is connected to the latch arm at a distal end of the flexible support.

* * * * *